United States Patent [19]

Viohl

[11] 4,028,114

[45] June 7, 1977

[54] PHOTOCHEMICAL SYSTEM FOR COATING THE LUMINESCENT SCREEN OF A COLOR TELEVISION PICTURE TUBE

[75] Inventor: Uwe Viohl, Aichschiess, Germany

[73] Assignee: International Standard Electric Corporation, New York, N.Y.

[22] Filed: Mar. 10, 1975

[21] Appl. No.: 557,220

[30] Foreign Application Priority Data

Mar. 12, 1974 Germany ..... 2411869

[52] U.S. Cl. ..... 96/93; 96/36.1

[51] Int. Cl.[2] ..... G03C 1/66; G03C 5/36

[58] Field of Search ..... 96/36.1, 93; 428/913; 427/68

[56] References Cited

UNITED STATES PATENTS

| | | | |
|---|---|---|---|
| 2,990,281 | 6/1961 | Printy et al. | 96/93 X |
| 3,558,310 | 1/1971 | Mayaud | 96/36.1 |
| 3,779,758 | 12/1973 | Polichette | 96/93 X |
| 3,788,846 | 1/1974 | Mayaud et al. | 96/36.1 |
| 3,887,371 | 6/1975 | Baker | 96/93 X |
| 3,906,515 | 9/1975 | Hosokoshi et al. | 96/36.1 X |
| 3,917,794 | 11/1975 | Akagi et al. | 96/36.1 X |

*Primary Examiner*—Thomas J. Herbert, Jr.

*Attorney, Agent, or Firm*—John T. O'Halloran; Thomas M. Marshall

[57] ABSTRACT

An improved photo-chemically active part of the fluorescent suspension for color TV picture tubes is provided. By adding polyether alcohol of the general formula $HOCH_2[CH_2OCH_2]_nCH_2OH$, three production factors are improved: adherence of the luminescent material to the glass, exposure time and reduced cross contamination.

1 Claim, No Drawings

PHOTOCHEMICAL SYSTEM FOR COATING THE LUMINESCENT SCREEN OF A COLOR TELEVISION PICTURE TUBE

BACKGROUND OF THE INVENTION

1. Field of the Invention

The invention concerns a photochemical system for coating luminescent screens of color television picture tubes containing, as photosensitive substances, polyvinyl alcohol and a salt of chromic acid.

2. Description of the Prior Art

The luminescent coating on the luminescent screen of color television picture tubes consists of a mosaic of various luminescent substances. Generally, these are red-, green- and blue-emitting luminescent substances.

In a known manner, the luminescent substances are applied to the glass screen, in a suspension forming a photochemical system, in a series of consecutive steps, whereupon each coating applied to the screen is exposed to light in precisely defined areas. The exposed areas of the coating remain adherent to the glass screen, while the rest is washed away in a further step.

The application of such a photochemical system entails problems that affect the quality of the luminescent coating. Thus the darkness reaction, i.e., the hardening of the suspension in the absence of light, and the exposure time dependent on the luminescent substances, lead to fluctuations in the size of the luminescent coating areas.

To overcome both problems, it was proposed to add to the polyvinyl alcohol layer certain quantities of ethan diol and propane triol, of which one will delay the darkness reaction and the other will accelerate the light reaction.

The drawbacks of this known solution of the problem lie in the facts that a special additive substance is required for each aforementioned problem and that this solution is not entirely and without further problems suitable for all luminescent substances.

In the mass production of goods that must meet exacting requirements with respect to a constant level of quality, the emphasis is on making the auxiliary means and methods within the framework of production as simple and trouble-free as possible.

SUMMARY OF THE INVENTION

It is therefore the object of the present invention to provide an improved photochemical system containing a photosensitive polyvinyl alcohol and salt of chromic acid including a polyether alcohol of the general formula $HOCH_2[CH_2OCH_2]^nCH_2OH$.

Application of the method in accordance with the invention has shown that improvement in the reaction to light of all luminescent substance suspensions, i.e., for the colors red, blue and green, leads to a significant shortening of the exposure time. This has as a consequence an increase in the capacity of the exposure installations. It was found, moreover, that there was improved adherence of the luminescent substances to the glass of the screen.

DESCRIPTION OF THE PREFERRED EMBODIMENT

With respect to the steps of the following procedure the coating of the luminescent screen, especially as regards the application of the emulsion preceding the aluminization, the luminescent substances applied in accordance with the invention show improved characteristics, as the emulsion lacquer does not penetrate the luminescent layer when the quantity $n$ of the proportion $[CH_2OCH_2]$ has a value equal to or greater than 2. This obviates the need for special measures to prevent penetration by the emulsion lacquer.

In a first example of carrying out the invention, the photochemical system consists in acqueous solution of polyvinyl alcohol — with about 250 g of polyvinyl alcohol (10%) and about 520 ml water — containing 280 g green luminescent substance, 20 ml ammonium bichromate and 22 ml $HOCH_2[CH_2OCH_2]_2CH_2OH$.

In a second example the photochemical system consists in an acqueous solution of polyvinyl alcohol — with about 350 g polyvinyl alcohol (10%) and 620 ml water — containing 280 g of blue luminescent substance, 21.6 ml ammonium bichromate and 14 ml $HOCH_2[CH_2OCH_2]_3CH_2OH$.

What is claimed is:

1. In a photochemical system for coating luminescent screens of color television picture tubes containing a photosensitive polyvinyl alcohol and a salt of chromic acid, the improvement comprising addition to said photochemical system of a polyether alcohol of the general formula $HOCH_2[CH_2OCH_2]_nCH_2OH$ wherein the quantity $n$ has a valve of from 2 to 3.

* * * * *